US005381977A

United States Patent [19]

Otte

[11] Patent Number: 5,381,977

[45] Date of Patent: Jan. 17, 1995

[54] APPARATUS FOR MATERIAL BED COMMINUTION OF BRITTLE MATERIAL FOR GRINDING

[75] Inventor: Olaf Otte, Oelde, Germany

[73] Assignee: Krupp Polysius AG, Germany

[21] Appl. No.: 111,990

[22] Filed: Aug. 25, 1993

[30] Foreign Application Priority Data

Sep. 24, 1992 [DE] Germany ..... 4232045

[51] Int. Cl.[6] ..... B02C 4/30

[52] U.S. Cl. ..... 241/227; 241/230; 241/293

[58] Field of Search ..... 241/227, 230, 235, 293

[56] References Cited

U.S. PATENT DOCUMENTS 4,703,897 11/1987 Beisner et al. ..... 241/24
4,840,315 6/1989 Rubin et al. ..... 241/24
5,054,701 10/1991 Durinck et al. ..... 241/167
5,203,513 4/1993 Keller et al. ..... 241/30

OTHER PUBLICATIONS

Cement-Data-Book, vol. 1, 3rd revised and enlarged new edition, by Walter H. Duda pp. 255-257, (1985).

*Primary Examiner*—John Husar
*Attorney, Agent, or Firm*—Learman & McCulloch

[57] ABSTRACT

The invention relates to apparatus for material bed comminution of brittle material for grinding, with two roll-like comminuting tools, in which the length:diameter ratio is in each case less than 1 and of which one tool is fixed and the other is mounted so as to be movable, wherein a working gap distance is maintained between the two comminuting tools in the unloaded starting position and the comminuted material for grinding is substantially pressed to form agglomerated scabs. In order to ensure a relatively low wear and a relatively maintenance-free operation the length:diameter ratio of the comminuting tools is less than approximately 0.3 and the diameter of the roll-like comminuting tools is chosen to be sufficiently great that the scab thickness is always greater than the working gap distance.

4 Claims, 2 Drawing Sheets

APPARATUS FOR MATERIAL BED COMMINUTION OF BRITTLE MATERIAL FOR GRINDING

The invention relates to apparatus for material bed comminution of brittle material for grinding.

BACKGROUND OF THE INVENTION

Apparatus of the aforementioned type is known above all under the term material bed roll mill (cf. in this connection, for example, Walter H. Duda, Cement-Data-Book, Volume 1, 3rd Edition 1985, pages 255 to 257). In these known material bed roll mills two comminuting rolls which are driven so as to rotate in opposite directions and are pressed against one another with a high pressure are provided as comminuting tools in which the length:diameter ratio is generally in the range from 0.3 to 1. In this case one comminuting roll, the so-called fixed roll, is mounted so as to be stationary, whilst the second roll, the so-called floating roll, is mounted so as to be movable relative to the first roll against the force of a spring. In the unloaded starting position a working gap distance is maintained between the two comminuting rolls with the aid of spacers, whereby the working surfaces of the rolls which cooperate in the comminuting work do not touch. A somewhat concave working surface develops on the outer peripheral surface of the rolls as a result of the corresponding depth of wear. The maximum depth of wear of these two working surfaces which are directed towards one another plus the so-called zero gap distance, i.e. the minimum peripheral distance between the two rolls when the spacers are juxtaposed, form the aforementioned working gap distance in the unloaded starting position (juxtaposed spacers).

In material bed comminution of brittle material for grinding, both individual grain comminution and also material bed comminution take place in the grinding gap between the two grinding rolls, in which case the material for grinding which is leaving the grinding gap, that is to say the comminuted material, is substantially pressed to form agglomerates, so-called "scabs", which can then be disagglomerated and/or further comminuted.

In efficient material comminution of the aforementioned type, the output or throughput rate, the grinding force, the roll mounting and the necessary grinding gap size (scab thickness) as well as the axial length and the diameter of the rolls play an essential part, the roll length generally being a resultant figure produced from the necessary output. In the choice of roll diameter and the length:diameter ratio there are various dependences which play a part. Thus in view of the relatively small proportion in percentage terms or the material bed which is pressed less at the roll edges it has proved favourable to choose relatively great roll lengths and thus relatively great length:diameter ratios. On the other hand, with smaller roll lengths or greater roll diameters, and thus smaller length:diameter ratios, it has proved favourable that the danger of skewing of the rolls is less, an even material feed can take place more easily and also the roll wear is less with thick scabs than with thin scabs which form with smaller roll diameters, since scab thickness and roll diameter are directly proportional. Since roll length and roll diameter determine as product the output of the apparatus, the length:diameter ratio basically has no influence of the output so long as the product of length and diameter remains the same.

However, in all these known types of construction particular difficulties are caused by the frequently high wear on the outer circumferential surfaces and thus on the working surfaces of the rolls. Even when the comminuting tools which are constructed as rolls have a cladding layer made from a suitable hard material on their outer circumference, during the comminuting operation the aforementioned somewhat concave working surface forms with a more or less great depth of wear in the region of the centre of the length of the roll, because in this central roll region the feed material is more easily drawn in than in the region of the edges of the rolls and because the pressure in the material bed is greatest in the region of the centre of the rolls.

Therefore in these known material bed roll mills it is necessary after a certain operating time to recondition the rolls, i.e. to re-turn or re-grind them or also to build them up by deposit welding of material at particular deep wear locations in order to equalise the resulting wear profile on the working surface. These various re-machining operations are not only time-consuming and costly but in many cases they also reduce the availability of the entire comminuting apparatus in a manner which is no longer acceptable. Moreover this is also a reason why these known material bed roll mills or material bed comminuting apparatus are accepted only hesitantly or not at all in industries in which particularly aggressive materials are comminuted.

The object of the invention, therefore, is to create a material bed comminuting apparatus which has a good output and is distinguished by a relatively uniform wear on the working surfaces of the the comminuting tools thereof and largely avoids the need for re-machining of these working surfaces.

SUMMARY OF THE INVENTION

The present invention makes use of the knowledge clearly developed in the tests on which it is based, namely that working surfaces formed by the outer circumferential surfaces of the comminuting tools are exposed to decreasing surface wear as the axial length becomes smaller and the diameter correspondingly greater, and that the wear profile which forms on these working surfaces stabilises after a certain wear time (operating time), i.e. after the development of a certain depth of wear the further wear no longer progresses more dramatically in the region of the centre of the length of the comminuting tools than in the region of the edges. Accordingly, in each roll-like comminuting tool a length:diameter ratio of <approximately 0.3 and particularly preferably <0.2 is chosen according to the invention. Therefore if, for example, roll-like comminuting tools are chosen for this apparatus according to the invention with a diameter of 1,000 mm, then the axial length thereof (working length) is at most 300 mm, but preferably only 200 mm or less. Even if in principle using comminuting tools constructed in this way it is possible to carry out a similar material bed comminution to that using the known material bed roll mill described in the introduction, then with the comminuting tools constructed according to the invention it is possible to talk not just of rolls, but rather of roll-like "comminuting wheels" and thus also of a "wheel press". Regardless of how the comminuting tools which are dimensioned according to the invention are designated, a maximum depth of wear of the working surface—as already indicated—is not exceeded, so that this working surface is further worn evenly substantially over the entire operational life of its external wear layer and no longer needs to be subjected to the costly re-machining operations explained above.

As will be explained in greater detail below with the aid of the drawings, in the case of this dimensioning according to the invention of the roll-like comminuting tools it is always necessary to choose the roll diameter to be of such a size that the scab thickness—that is to say the thickness of the agglomerates or press cakes produced in the comminuting operation or in the material bed comminution—is always greater than the working gap distance.

THE DRAWINGS

In the further explanation of the invention which follows reference may be made to the accompanying drawings, in which.

DETAILED DESCRIPTION

Figure 1:
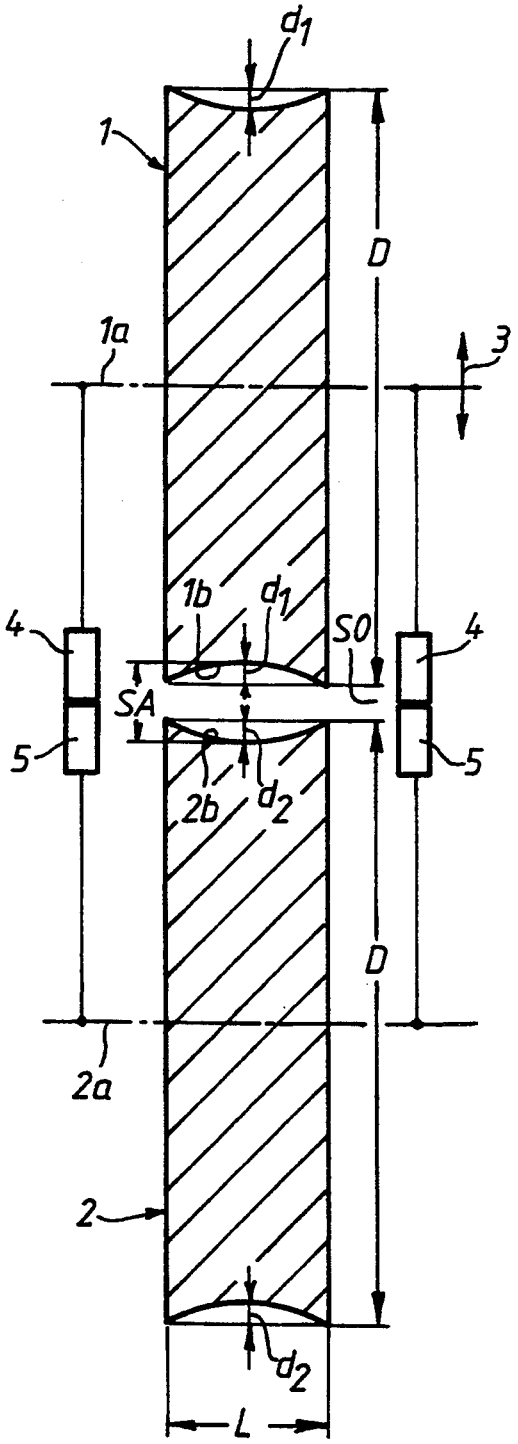
FIG. 1 shows a schematic side view of the two roll-like comminuting tools of the apparatus according to the invention in their unloaded starting position.
Figure 2:
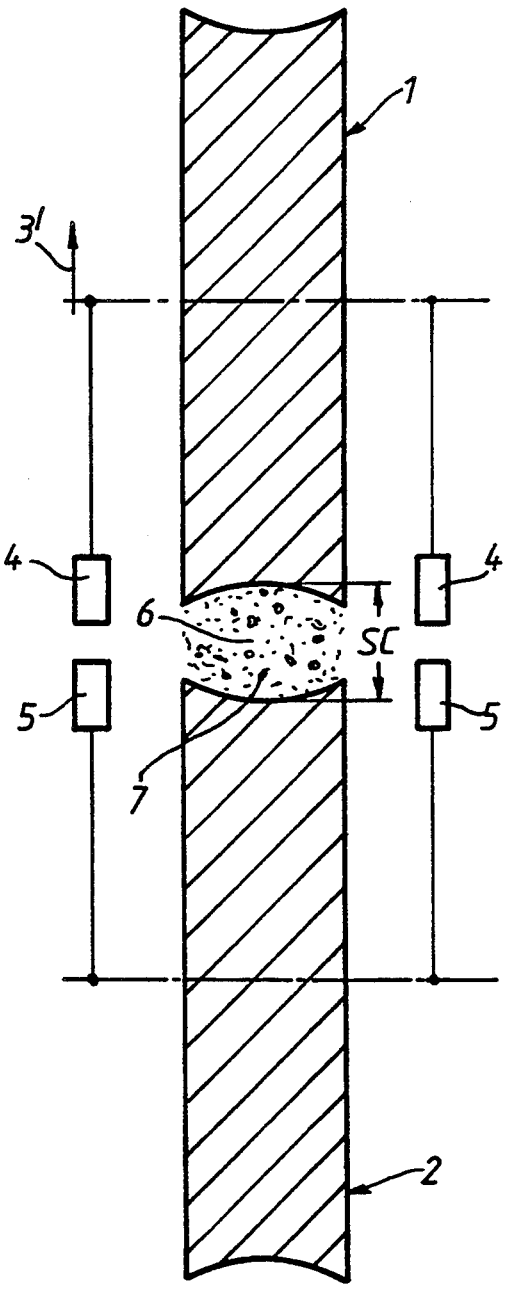
FIG. 2 shows a similar schematic sectional representation to that of FIG. 1, but in which the rolls form a wider grinding gap between them by drawing in material for grinding.

First of all the general construction of the material bed comminuting apparatus according to the invention may be explained in greater detail with the aid of FIGS. 1 and 2, in which only the parts which are essential for the explanation of the present invention are shown schematically. Since the same apparatus is shown in both Figures of the drawings, on the one hand in the unloaded starting position (FIG. 1), i.e. when no material for grinding is being delivered, and on the other hand in the working position or in the operational state (FIG. 2), the same apparatus parts are present in both Figures and thus are provided with the same references.

The material bed comminuting apparatus according to FIGS. 1 and 2 contains two roll-like comminuting tools 1, 2 which are co-ordinated as a pair, are both of similar construction and dimensions and on the basis of their dimensions are designated below for the sake of simplicity as "roll wheels" 1, 2. Both roll wheels 1, 2—as is known per se from material bed roll mills—can be driven in rotation by drive arrangements which are not shown in greater detail and their axes of rotation 1*a*, 2*a* respectively, and they are pressed against one another with a high pressure (by means which are equally known per se). As is also known per se from material bed roll mills, one roll wheel 2 is mounted fixed, whilst the other roll wheel 1 is mounted so as to be movable relative to the first roll wheel 2 against the force of a spring (cf. arrow 3).

In the unloaded starting position (inoperative position, in which no material for grinding is delivered) illustrated in FIG. 1, between the working surfaces 1*b* and 2*b* constructed on the outer circumferential surfaces of the roll wheels 1, 2 respectively a working gap SA is maintained with the aid of spaces which—as shown in FIG. 1—are juxtaposed in this starting position of the roll wheels 1, 2 so that in the case of the working surfaces 1*b*, 2*b* of each roll wheel 1, 2 rendered concave by material wear at the end regions a minimum zero distance SO, corresponding to the initial spacing between the rolls when unloaded, is maintained which ensures that the working surfaces 1*b* and 2*b* of the two roll wheels 1, 2 cannot touch. The maximum depth of wear which is produced during the comminuting work of the roll wheels 1, 2 is designated in FIG. 1 by $d_1$ (for roll wheel 1) and $d_2$ (for roll wheel 2) and is located in the region of the centre of the length of each roll wheel 1, 2 respectively. The representation in FIG. 1 also shows that the sum of the maximum depths of wear $d_1$ and $d_2$ of both roll wheels 1, 2 and the minimum zero distance SO produces the aforementioned working gap distance SA.

When this material bed comminuting apparatus carries out comminuting work, i.e. when material for grinding is delivered to the grinding gap 6 formed between the two working surfaces 1*b* and 2*b* and is comminuted therein under the application or high pressure, not only does a comminution of the material for grinding 7 located in the grinding gap occur but this material for grinding is compressed (as is known per se from material bed roll mills) to form so-called "scabs", i.e. agglomerates or press cakes. In order to be able to carry out this comminuting process effectively, the roll diameter must be chosen as a function of the intake of the material for grinding which is to be comminuted so that is of such a size that in the operating state a grinding gap 6 (=SC) forms which is larger than the working gap distance (SA). A sufficiently large quantity of material is then delivered to the grinding gap 6 that the floating roll wheel 1 is pushed against the spring force acting on this roll wheel in the direction of the arrow 3', as shown in FIG. 2. In this case the spacers 4, 5 also move apart in a corresponding manner. In fact reliable material bed comminution is only carried out when the material for grinding 7 which is to be comminuted is drawn in by the two roll wheels 1, 2 into the grinding gap 6 in such a way that the spacers 4 of the floating roll wheel 1 lift off from the spacers 5 or the fixed roll wheel 2 against a spring force and only thereby is the transfer of pressure or grinding force to the material bed formed in the grinding gap 6 made possible (for comminution of the material for grinding and for formation of scabs).

As has already been mentioned above, in this material bed comminution apparatus according to the invention length:diameter (LD) ratio of the roll wheels 1, 2 of <approximately 0.3, preferably 0.2, is chosen.

In the dimensioning of the roll wheels 1, 2 the starting point can basically be the formula set out below which is known per se from material bed roll mills:

$$M = m * D L * u \quad (1)$$

where

M=output (t/h)

m=specific throughput rate ($t * s/m^3 * h$)

D=diameter (m)

L=axial length (m)

u=circumferential velocity of the roll wheels (m/s)

In this type of material bed comminution the scab thickness SC is produced as a function of the ease of intake of the feed material, and in fact according to the following formula:

$$SC = \frac{m*D}{\rho*3.6} \text{ <mm>} \quad (2)$$

where m=specific throughput rate (t * s/m$^3$ * h)
D=diameter of the roll wheels (m)
$\rho$=scab density (t/m$^3$)

If one considers the last mentioned formula (2), then the linear dependence of the scab thickness upon the roll wheel diameter D can be seen there. From this it may also be understood that in the dimensioning of the roll wheels 1, 2 according to the invention the working gap SA must always be smaller than the scab thickness SC, because in the reverse case no clear scabs could form since then the pressure of spring force of the floating roll wheel 1 with the spacers 4, 5 closed would be passed directly into the bearings of the roll wheels 1, 2, but not into the material for grinding 7 to be comminuted in the grinding Gap 6.

Figure 3:
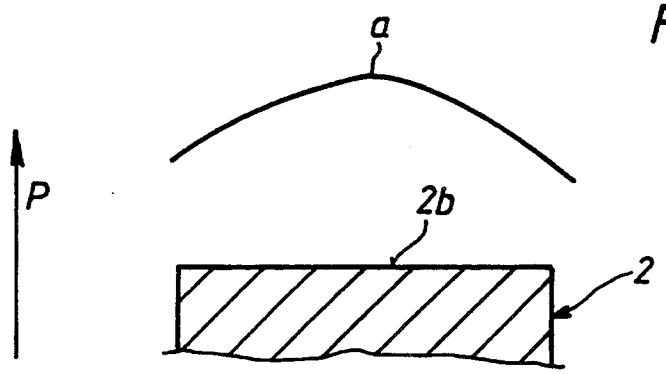
FIG. 3 shows a partial cross-sectional view through a largely unused comminuting tool, with appertaining load curve.
Figure 4:
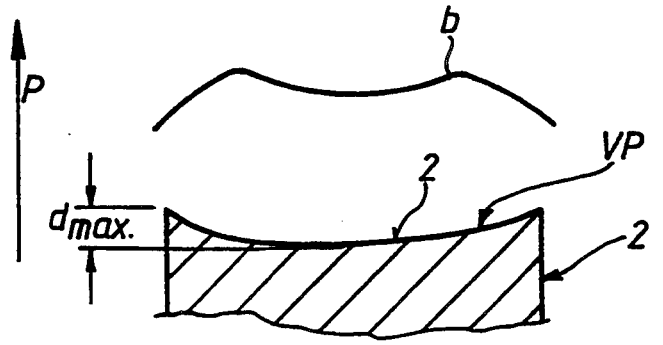
FIG. 4 shows a partial cross-sectional view through a normally used comminuting tool, with a concave ground working surface and a load curve altered thereby.

As has already been explained above, in the case of brittle materials for grinding which wear strongly a working surface 1*b*, 2*b* forms on the external circumferential surfaces of each roll wheel (comminuting tool) with a wear profile in approximately concave form, as can be seen on the one hand in FIGS. 1 and 2 and on the other hand in the detail view in FIG. 4 (designated by VP here). This means that in practical use the working surface in the starting or new state of a roll wheel, e.g. the roll wheel 2 in FIG. 3, is approximately or largely cylindrical, as is indicated in FIG. 3 at 2*b*. During the comminution work with this substantially cylindrical working surface 2*b* shown in FIG. 3 the pressure P is greatest in the region of the centre of the roll (centre of the length of the roll) (as is indicated by the circular curve a), so that the greatest wear also occurs there. Only with the development of the concave wear profile VP on the working surface 2*b* (FIG. 4) does the maximum pressure P in the grinding gap 6 or in the region of the centre of the roll wheel (centre of the length) become flatter, and in fact approximately two-peaked, as the curve b in FIG. 4 shows; when this state is reached the wear is approximately stabilised over the entire length, so that accordingly the wear progresses uniformly over the entire length L of the roll wheel as the diameter D decreases.

Thus on the basis of the preceding explanation it may be said that the maximum depth $d_{max}$ of the wear profile VP increases with the width of the roll whilst the material for grinding and the wear materials remain the same. This is also shown by the empirical observation that the maximum depth of wear profile may be described approximately by the following formula:

$$d_{max} = t * L \quad (3)$$

where $d_{max}$=maximum depth of wear profile (mm)
t=constant
L=axial length (mm)

The constant t is fixed according to the invention at a figure of <approximately 0.025, preferably approximately in the region of 0.02. This results in a favourable optimisation of construction in the dimensioning of the roll wheels 1, 2.

If the dimensioning of the roll wheels 1, 2 is based on the above formulae (1), (2) and (3), a constant t=0.025 and a minimum zero gap SO, then according to the following formula this results in the maximum permissible axial (working) length of the roll wheels 1, 2:

$$L_{max} = \frac{m*D2}{\rho*7200*t} - \frac{SO}{2000*t} \quad (4)$$

and thus $$L_{max} = \frac{m*D2}{\rho*180} - \frac{SO}{50} \quad (5)$$

where $L_{max}$=maximum axial length (m)
D2=smallest diameter (with worn cladding) (m)
m=specific output (t * s /m$^3$ * h)
SO=zero gap (mm)
$\rho$=scab density (t/m$^3$)

When the roll-like comminuting tools, i.e. the roll wheels 1, 2, of this material comminuting apparatus according to the invention are dimensioned and constructed in the manner explained above, then a relatively small maximum depth of wear profile $d_{max}$ is produced on the working surfaces 1*b*, 2*b*, and simultaneously a relatively small scab thickness SC can be set, so that the working gap distances A is always smaller than the scab thickness SC of the comminuted material for grinding. This material bed comminuting apparatus can then operate almost without maintenance, because the comminuting tools roll wheels 1 and 2 can wear by the formation of their natural wear profile without a periodic re-machining of the wear or working surfaces being necessary in the manner described in the introduction (in the case of the known constructions) so that the working gap distance SA can always be kept smaller than the scab thickness. Only in exceptional cases might it once be necessary in the meantime to turn or grind off the outer circumferential surfaces of the comminuting tools if unacceptable profiles or wearing out of true occur because of uneven running of the apparatus or because of inhomogeneous materials. In the construction according to the invention the roll-like comminuting tools (roll wheels) can have a cladding layer made from particularly herd wear material which is optimally adapted to the particular comminuting purpose, in which case such an outer circumferential cladding can be produced from a solid wrapping, composite cast segments, cladding segments or a composite cast wrapping or also a hardfacing. Moreover, the outer circumferential surface of these comminuting tools can also be adapted in a favourable manner to the purpose for which the apparatus is to be used, for which this outer circumferential surface or working surface can be smooth, structured or can be formed by profiles which are applied (e.g. welded on, adhered).

I claim:

1. Apparatus for the comminution of brittle material comprising: a pair of comminuting rolls mounted for driven rotation in opposite relative directions and biased toward one another at high pressure to define a grinding gap therebetween through which the brittle material may be passed and comminuted into agglomerated scabs, said rolls having lengths and initial diameters selected to optimize roll performance according to the formula:

$$L_{max} = \left[ \frac{m}{\rho} + \frac{D2}{7200} - \frac{SO}{2000} \right] \frac{1}{t} \quad (1)$$

wherein $L_{max}$=maximum length of the rolls, m=specific output of apparatus,

D2=smallest permissible worn diameter of rolls, $\rho$=scab density,

SO=initial dimension of grinding gap before roll wear, and t=constant;

and $$\frac{L}{D} \leqq 0.3 \quad (2)$$

wherein,

L=selected length of rolls, and

D=selected diameter of rolls.

2. The apparatus of claim 1 wherein t=0.025.

3. The apparatus of claim 2 wherein said rolls when worn develop a concave profile having a maximum depth of wear in relation to the original roll diameter determined according to the formula:

$$d_{max} = t.L$$

where $d_{max}$=maximum depth of wear, t=0.025, and

L=selected roll length.

4. The apparatus of claim 1 wherein said comminuting rolls include an outer cladding of wear-resistant material.

* * * * *

UNITED STATES PATENT AND TRADEMARK OFFICE

CERTIFICATE OF CORRECTION

PATENT NO. : 5,381,977
DATED : January 17, 1995
INVENTOR(S) : Olaf Otte

It is certified that error appears in the above-indentified patent and that said Letters Patent is hereby corrected as shown below:

Column 1, line 55, change "or" to -- of --

Column 4, line 23, change "or" to -- of --; line 45, change "or" to -- of --; line 53, before "0.2" insert the symbol -- $\leq$ --

Column 6, line 47, change "herd" to -- hard --

Col. 7, line 3,
Claim 1, in the equation, change "+" to -- $\div$ --

Signed and Sealed this

Sixteenth Day of May, 1995

*Attest:*

Bruce Lehman

BRUCE LEHMAN

*Attesting Officer*

*Commissioner of Patents and Trademarks*